US008782986B1

(12) United States Patent
Tsai

(10) Patent No.: US 8,782,986 B1
(45) Date of Patent: Jul. 22, 2014

(54) SLAB MODULE FOR A RAISED FLOOR

(71) Applicant: Che-An Tsai, Kaohsiung (TW)

(72) Inventor: Che-An Tsai, Kaohsiung (TW)

( * ) Notice: Subject to any disclaimer, the term of this patent is extended or adjusted under 35 U.S.C. 154(b) by 0 days.

(21) Appl. No.: 14/011,688

(22) Filed: Aug. 27, 2013

(30) Foreign Application Priority Data

Apr. 25, 2013 (TW) ..... 102207583 U

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04B 5/04*** | (2006.01) |
| ***E04F 15/02*** | (2006.01) |

(52) U.S. Cl.
CPC .. *E04B 5/04* (2013.01); *E04F 15/02* (2013.01)
USPC ..... 52/506.06

(58) Field of Classification Search
CPC ..... E04F 13/0862; E04F 13/142; E04F 15/02; E04F 15/02405; E04F 15/08; E04F 15/024; E04F 15/082
USPC ..... 52/506.06
See application file for complete search history.

(56) References Cited

U.S. PATENT DOCUMENTS

| | | | | |
|---|---|---|---|---|
| 5,412,914 | A * | 5/1995 | Daw et al. | 52/126.6 |
| 5,904,015 | A * | 5/1999 | Chen | 52/220.2 |
| 6,665,996 | B2 * | 12/2003 | Chang | 52/799.1 |
| 6,694,689 | B1 * | 2/2004 | Scott et al. | 52/392 |
| 7,197,855 | B2 * | 4/2007 | Della Pepa | 52/460 |
| 7,263,811 | B1 * | 9/2007 | Clemmer | 52/745.19 |
| 7,487,622 | B2 * | 2/2009 | Wang | 52/384 |
| 7,866,104 | B2 * | 1/2011 | Babinsky et al. | 52/403.1 |
| 2002/0078646 | A1 * | 6/2002 | Eaton | 52/292 |

* cited by examiner

*Primary Examiner* — Mark Wendell

(57) ABSTRACT

A slab module includes a stone slab having a thickness of 3-10 mm. A reinforcing plate includes a first side fixed to a rear side of the stone slab. The reinforcing plate has an area corresponding to an area of the stone slab. A base is made of a rigid material and includes a coupling face on a top side thereof. The coupling face is fixed to a second side of the reinforcing plate. A plurality of posts is provided below the coupling face, with a compartment formed between the posts for receiving a wire.

2 Claims, 9 Drawing Sheets

A – A

SLAB MODULE FOR A RAISED FLOOR

BACKGROUND OF THE INVENTION

The present invention relates to a slab module for a raised floor and, more particularly, to a light, easy-to-install slab module for construction of a raised floor.

Stone slabs for a floor generally have a thickness of 18-30 mm and are fixed to the ground through wet-type processing. The natural grain of the stone slabs provides enhanced quality. However, it is difficult to remove the stone slabs fixed to the ground and difficult to install wires below the stone slabs. In addition to difficulties in installation, use of the stone slabs in offices and exhibition sites is not easy.

FIG. 9 shows a raised floor for assemblage maneuverability and easy wiring. The raised floor includes a plurality of slabs 1' supported by a plurality of posts 2 and spaced from the ground. Wires can be mounted below the slabs 1'. The slabs 1' and the posts 2' can easily be detached to provide enhanced assemblage application. The slabs 1' are generally made of wood or metal. Although stone slabs can be mounted on top of posts 2', the stone slabs could break at central areas not supported by the posts 2'. If the thickness of the stone slabs is increased to be more than 20 mm, the weighty stone slabs are not easy to handle and are expensive and not eco-friendly.

BRIEF SUMMARY OF THE INVENTION

An objective of the present invention is to provide a light, easy-to-install slab module for construction of a raised floor.

A slab module according to the present invention includes a stone slab having a thickness of 3-10 mm. A reinforcing plate includes a first side fixed to a rear side of the stone slab. The reinforcing plate has an area corresponding to an area of the stone slab. A base is made of a rigid material and includes a coupling face on a top side thereof. The coupling face is fixed to a second side of the reinforcing plate. A plurality of posts is provided below the coupling face, with a compartment formed between the plurality of posts and adapted to receive a wire.

Preferably, the base is made of plastic material and formed by injection molding to include a modularized size.

Preferably, the reinforcing plate is a foamed temperature-keeping board made of high-density polyethylene (HDPE) or extruded polystyrene (XPS), or a sheet made of foamed expanded polyvinyl chloride, polystyrene, calcium silicate, or magnesium oxide, or an aluminum honeycomb panel.

Preferably, the first side of the reinforcing plate is fixed to the stone slab by glue, and the coupling face of the base is fixed to the second side of the reinforcing slab by glue.

In examples, the base includes a peripheral wall extending perpendicularly to the coupling face. The peripheral wall is adapted to be spaced from a ground and includes a slot facing the ground. The wire is adapted to extend through the slot.

A plurality of slab modules can be assembled on the ground to form a raised floor, wherein the posts of the base of each slab module are directly placed on the ground, and the slab modules are placed side by side to form a grid structure. The wire can extend through the slot below the annular wall and through the compartment in each slab module, allowing easy wiring. A weight imparted to the top side of the raised floor is supported by the reinforcing plate and the base of each slab module, providing enhanced support. The natural grain on the stone slab of each slab module provides enhanced quality. Use of the stone slab saves more material than using conventional stone slabs having a thickness more than 18 mm. The costs are cut while providing environmental protection and reducing waste of natural resources. Moisture on the ground can not penetrate into the stone slabs spaced from the ground, providing a longer service life. The raised floor can be rapidly detached and then assembled on another site due to modularization of the slab modules, providing maneuverability and wider applications.

Each of the plurality of posts of the base can include an arcuate face facing the compartment. The arcuate face 321 avoids the wire 4 from friction or getting stuck, allow easy wiring.

In an example, a bumper strip is provided and includes first and second lateral edges made of a rigid material and a flange made of a soft material and extending between the first and second lateral edges. The peripheral wall of base includes a plurality of sides, with each of the plurality of sides of the peripheral wall including an engagement groove. The first lateral edge of the bumper strip is engaged in the engagement groove in one of the plurality of sides of the peripheral wall of a slab module. The second lateral edge of the bumper strip is engaged with an engagement groove in one of a plurality of sides of the peripheral wall of another slab module, with the flange located between the two slab module to provide enhanced overall quality after installation while providing a shock absorbing effect and reducing impact noise resulting from an external force imparted to the raised floor.

The present invention will become clearer in light of the following detailed description of illustrative embodiments of this invention described in connection with the drawings.

DETAILED DESCRIPTION OF THE INVENTION

Figure 1:
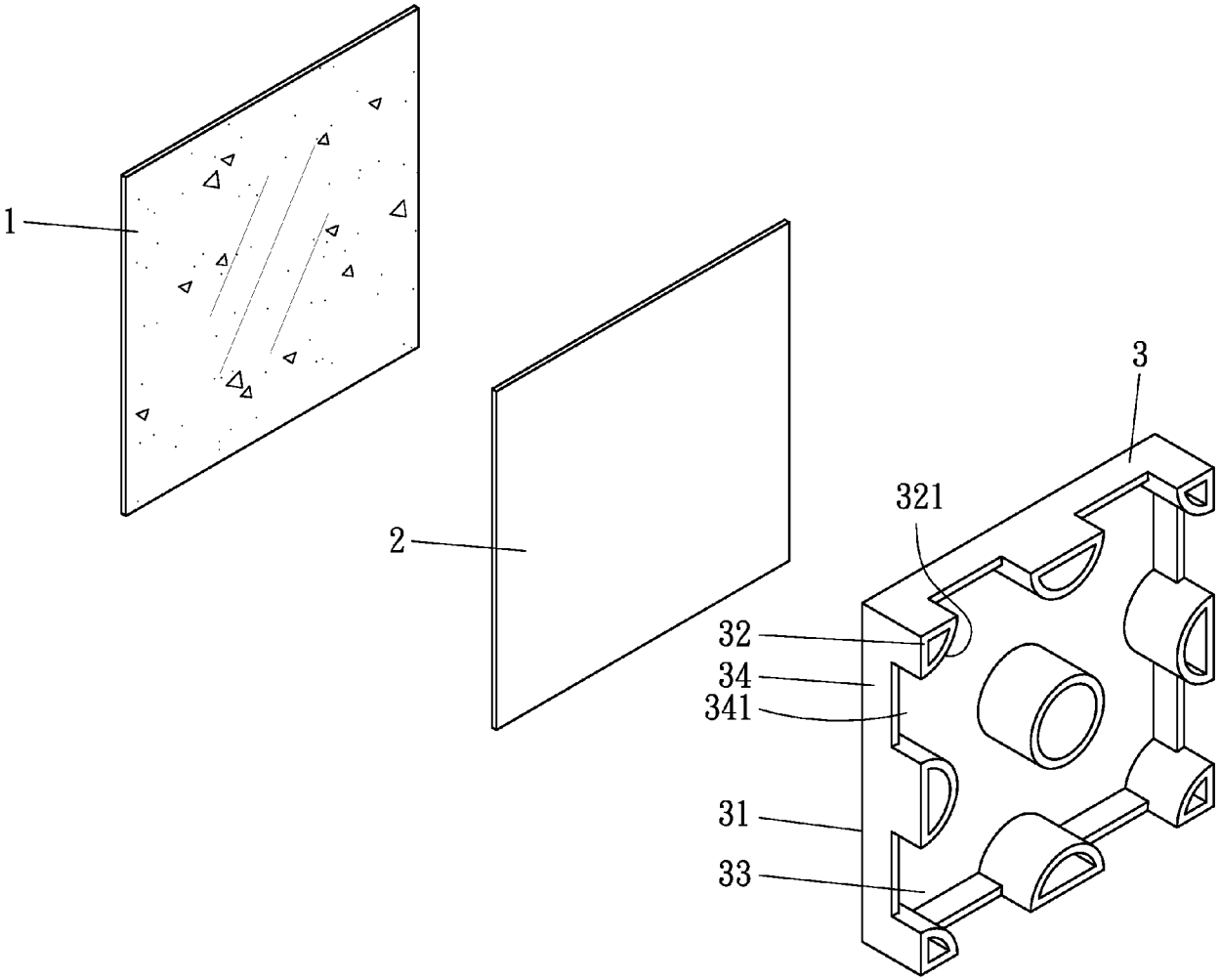
FIG. 1 is an exploded, perspective view of a slab module for a raised floor of a first example according to the present invention.
Figure 2:
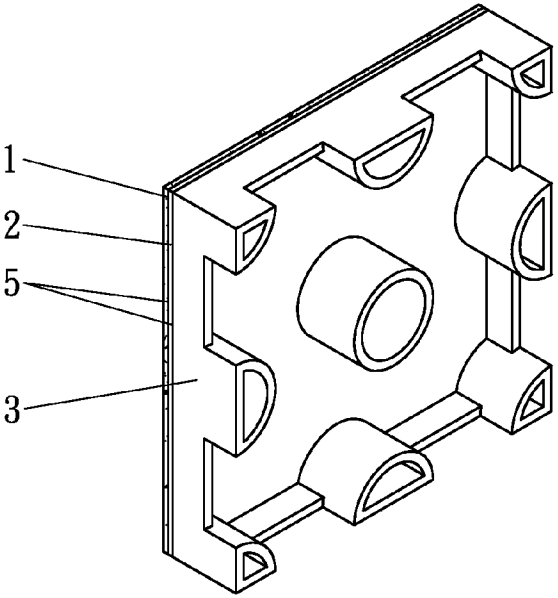
FIG. 2 is a perspective view of the slab module of FIG. 1.
Figure 3:
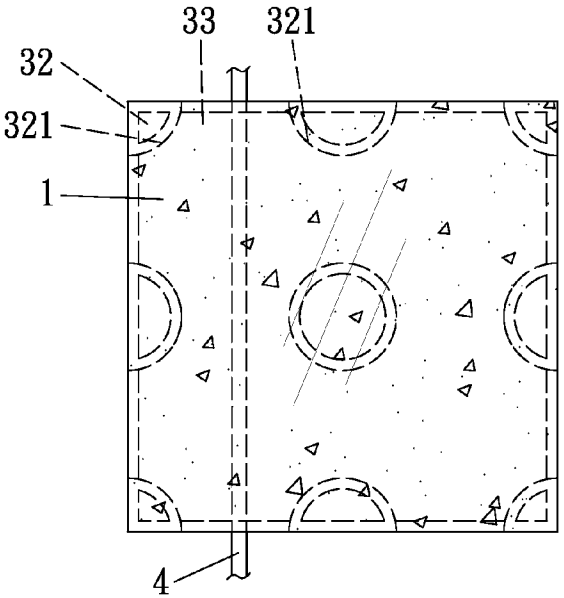
FIG. 3 is a top view of the slab module of FIG. 1.

With reference to FIGS. 1-3, a slab module for a raised floor of a first example according to the present invention includes a stone slab 1, a reinforcing plate 2, and a base 3. The stone slab 1 has a thickness of 3-10 mm. The reinforcing plate 2 includes a first side fixed to a rear side of the stone slab 1 by glue 5 and has an area corresponding to an area of the stone slab 1. The reinforcing plate 2 is a foamed temperature-keeping board made of high-density polyethylene (HDPE) or extruded polystyrene (XPS), or a sheet made of foamed expanded polyvinyl chloride, polystyrene, calcium silicate, or magnesium oxide, or an aluminum honeycomb panel. The strength of the stone slab 1 is reinforced by the reinforcing plate 2 having a light weight.

The base 3 is made of a rigid plastic material and formed by injection molding (one time injection molding or multiple injection molding) to include a modularized size. The base 3 includes a coupling face 31 on a top side thereof. A plurality of posts 32 is provided below the coupling face 31, with a compartment 33 formed between the posts 32 and adapted to receive a wire 4. The base 3 includes a peripheral wall 34 extending perpendicularly to the coupling face 31. The peripheral wall 34 reinforces the strength of the base 3. The peripheral wall 34 is adapted to be spaced from the ground and includes a slot 341 facing the ground. The wire 4 is adapted to extend through the slot 341. Each post 32 of the base 3 includes an arcuate face 321 facing the compartment 33. The arcuate face 321 avoids the wire 4 from friction or getting stuck, allow easy wiring. The coupling face 31 of the base 3 is fixed to a second side of the reinforcing slab 1 by glue 5. Thus, the base 3 increases the strength of the stone slab 1. The whole slab module is light and can easily be moved during installation.

Figure 4:
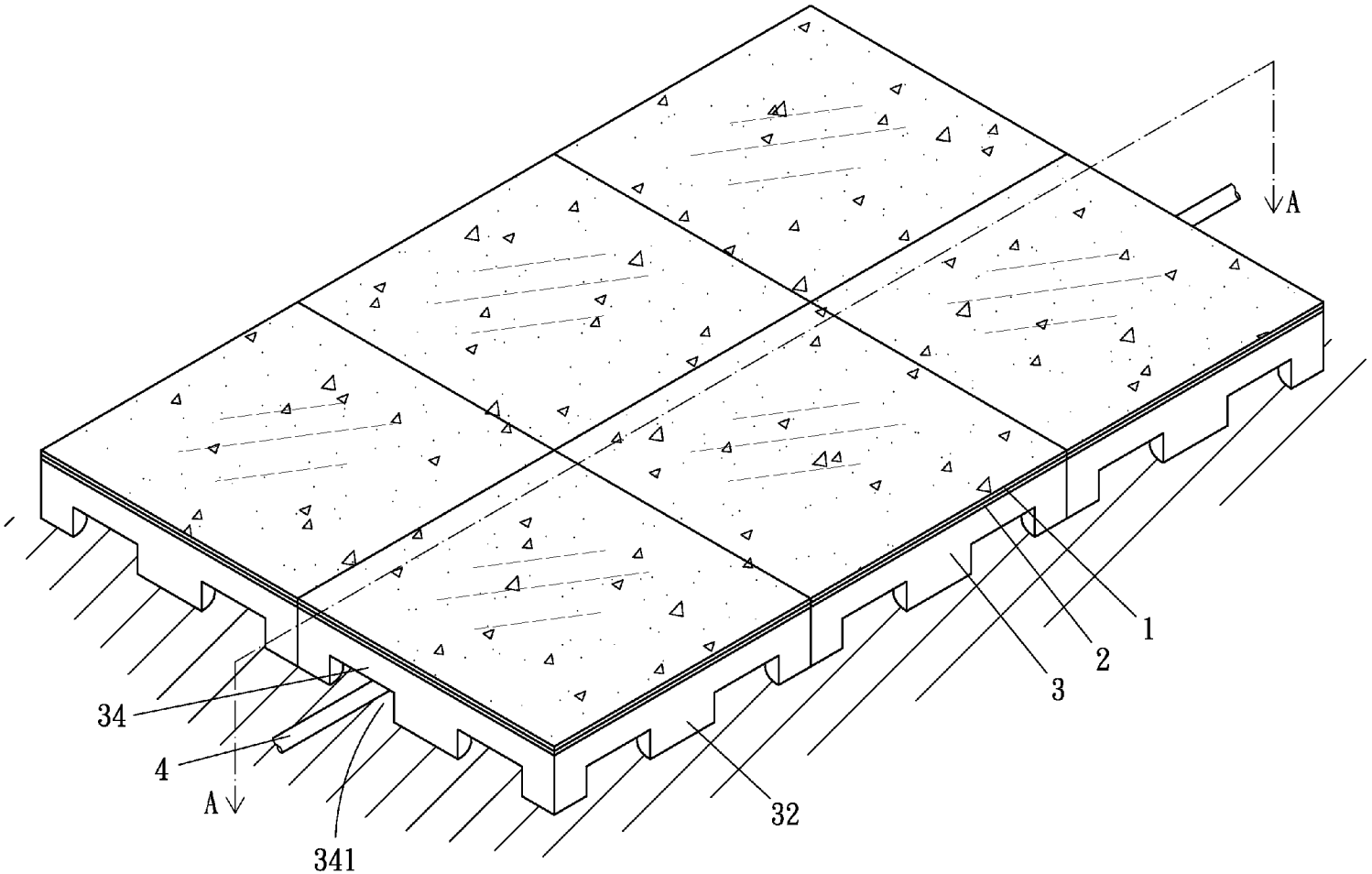
FIG. 4 is a perspective view of a raised module constructed by a plurality of slab modules of FIG. 1.
Figure 5:
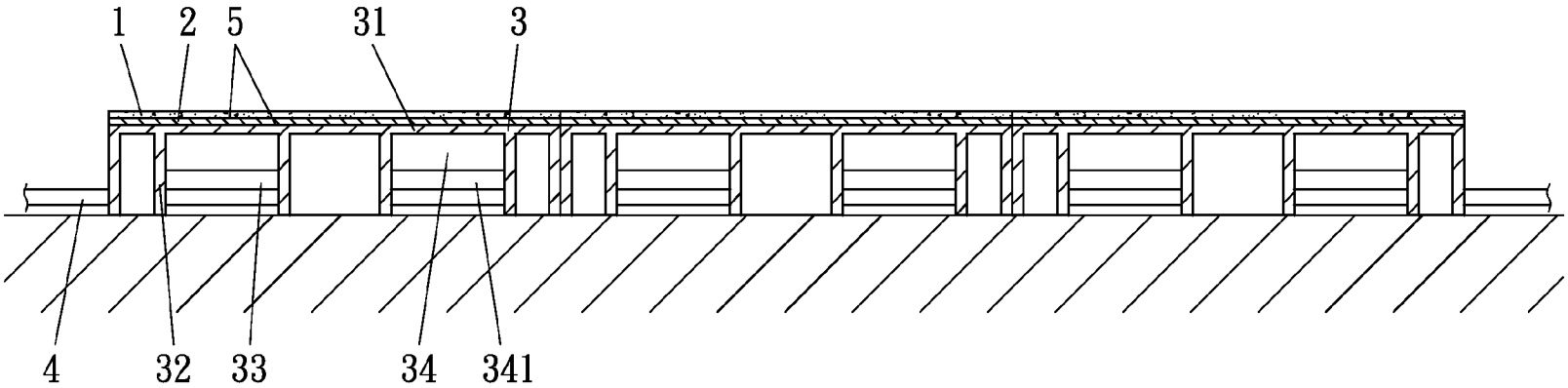
FIG. 5 is a cross sectional view taken along section line A-A of FIG. 4.

With reference to FIGS. 4 and 5, in assemblage of a plurality of slab modules on the ground to form a raised floor, the posts 32 of the base 3 of each slab module are directly placed on the ground, and the slab modules are placed side by side to form a grid structure. The wire 4 can extend through the slot 341 below the annular wall 34 and through the compartment 33 in each slab module, allowing easy wiring. A weight imparted to the top side of the raised floor is supported by the reinforcing plate 2 and the base 3 of each slab module, providing enhanced support. The natural grain on the stone slab 1 of each slab module provides enhanced quality. Use of the stone slab 1 saves more material than using conventional stone slabs having a thickness more than 18 mm. The costs are cut while providing environmental protection and reducing waste of natural resources. Moisture on the ground can not penetrate into the stone slabs spaced from the ground, providing a longer service life.

The raised floor can be rapidly detached and then assembled on another site due to modularization of the slab modules, providing maneuverability and wider applications.

Figure 6:
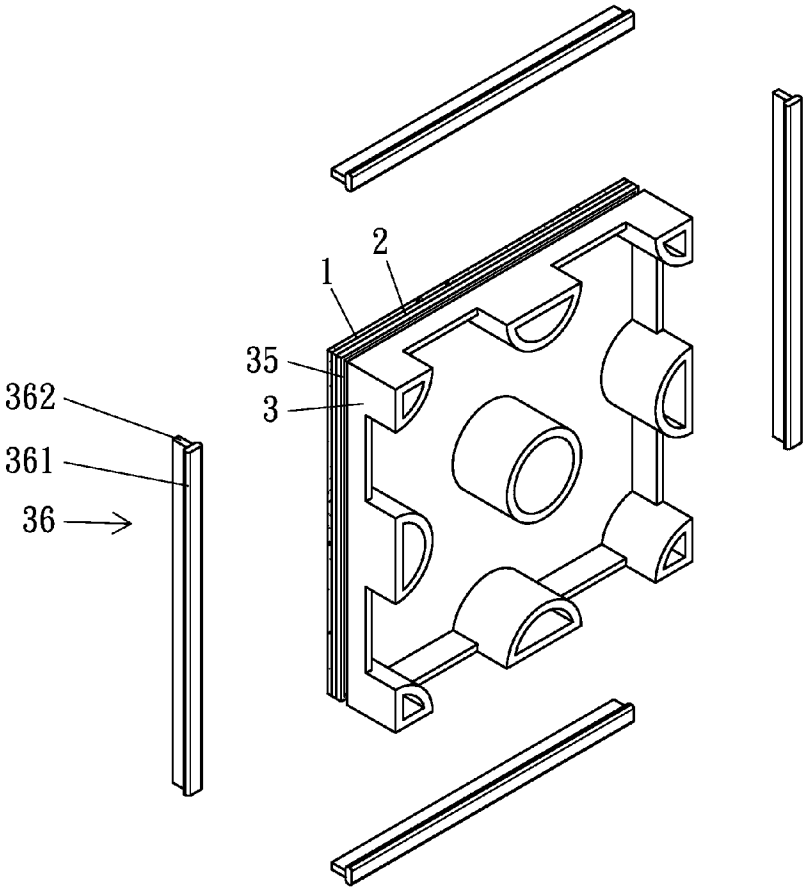
FIG. 6 is an exploded, perspective view of a slab module of a second example according to the present invention.
Figure 7:
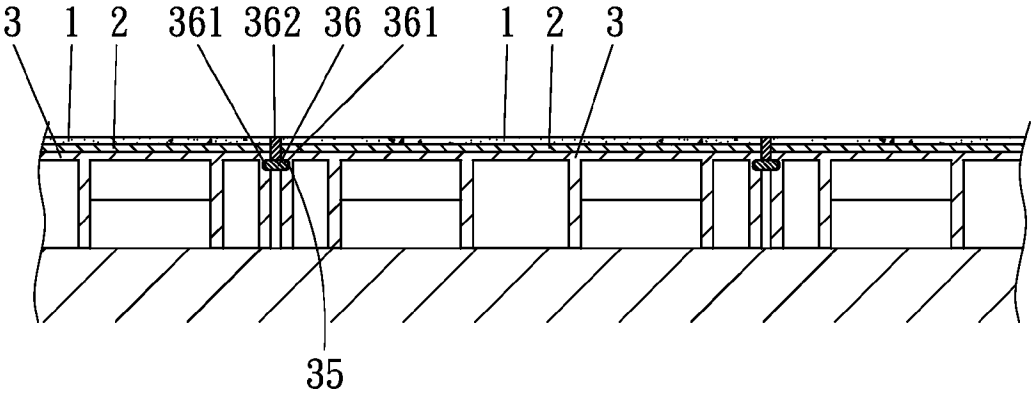
FIG. 7 is a cross sectional view of a raised floor constructed by a plurality of slab modules of FIG. 6.

FIGS. 6 and 7 show a second example of the present invention, wherein a bumper strip 36 is provided between two adjacent slab modules. Specifically, the bumper strip 36 includes first and second lateral edges 361 made of a rigid material and a flange 362 made of a soft material and extending between the first and second lateral edges 361. The peripheral wall 34 of base 3 includes a plurality of sides, with each side of the peripheral wall 34 including an engagement groove 35. In engagement of two slab modules, the first lateral edge 361 of the bumper strip 36 is engaged in the engagement groove 35 in one of the sides of the peripheral wall 34 of one of the slab modules. The second lateral edge 361 of the bumper strip 36 is engaged with the engagement groove 35 in one of the sides of the peripheral wall 34 of the other slab module, with the flange 362 located between the two slab modules to provide enhanced overall quality after installation while providing a shock absorbing effect and reducing impact noise resulting from an external force imparted to the raised floor.

Figure 8:
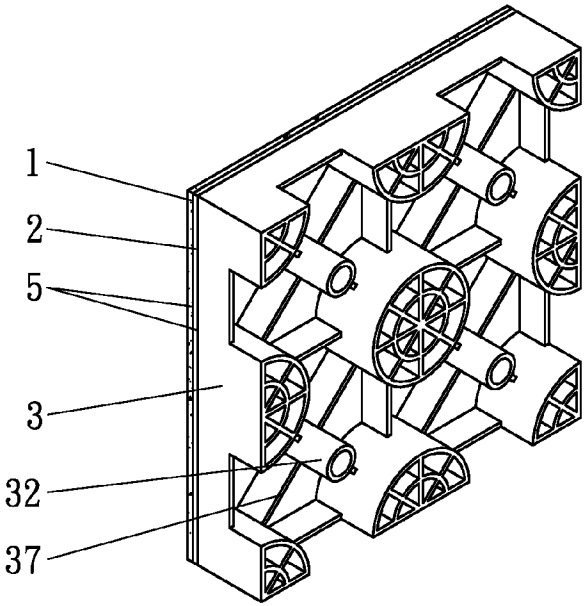
FIG. 8 is a perspective view of a slab module of a third example according to the present invention.
Figure 9:
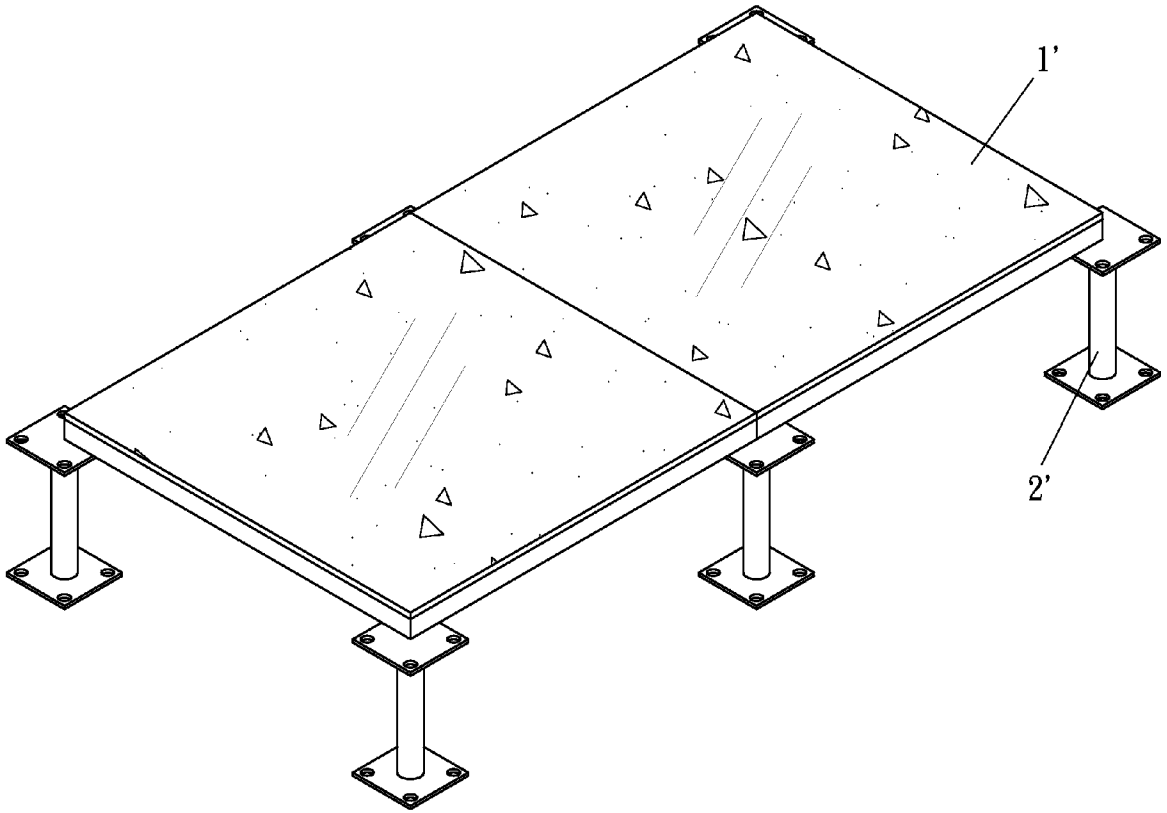
FIG. 9 is a perspective view of a conventional raised floor.

FIG. 8 shows a third example of the present invention, wherein the base 3 includes more posts 32, and two adjacent posts 32 are connected to each other by a reinforcing rib 37 to provide enhanced strength for supporting purposes. The number of the posts 32 is selected according to the size of the base 3 to provide enhanced supporting stability.

Note that a raised floor having a small area can be formed by a single slab module.

Although specific embodiments have been illustrated and described, numerous modifications and variations are still possible without departing from the scope of the invention. The scope of the invention is limited by the accompanying claims.

The invention claimed is:

1. A slab module for a raised floor comprising:

a stone slab having a thickness of 3-10 mm, with the stone slab having a rear side;

a reinforcing plate including a first side fixed to the rear side of the stone slab and a second side, with the reinforcing plate having an area corresponding to an area of the stone slab; and a base made of a rigid material, with the base including a coupling face on a top side thereof, with the coupling face fixed to the second side of the reinforcing plate, with a plurality of posts provided below the coupling face, with a compartment formed between the plurality of posts and adapted to receive a wire, with the first side of the reinforcing plate fixed to the stone slab by glue, with the coupling face of the base fixed to the second side of the reinforcing slab by glue, further comprising:

a bumper strip including first and second lateral edges and a flange extending between the first and second lateral edges, with the peripheral wall of base including a plurality of sides, with each of the plurality of sides of the peripheral wall including an engagement groove, with the first lateral edge of the bumper strip engaged in the engagement groove in one of the plurality of sides of the peripheral wall, with the second lateral edge of the bumper strip adapted to be engaged with an engagement groove in one of a plurality of sides of the peripheral wall of a similarly constructed slab module, with the flange located between the slab module and the similarly constructed slab module.

2. The slab module as claimed in claim 1, with the first and second lateral edges of the bumper strip made of a rigid material, with the flange made of a soft material.

* * * * *